US007295121B2

(12) United States Patent
Aceti

(10) Patent No.: US 7,295,121 B2
(45) Date of Patent: Nov. 13, 2007

(54) METHODS AND APPARATUS FOR AURALLY PRESENTING NOTIFICATION MESSAGE IN AN AUDITORY CANAL

(75) Inventor: John Gregory Aceti, West Windsor, NJ (US)

(73) Assignee: Sarnoff Corporation, Princeton, NJ (US)

( * ) Notice: Subject to any disclaimer, the term of this patent is extended or adjusted under 35 U.S.C. 154(b) by 116 days.

(21) Appl. No.: 10/927,852

(22) Filed: Aug. 27, 2004

(65) Prior Publication Data

US 2006/0045278 A1 Mar. 2, 2006

(51) Int. Cl.
*G08B 23/00* (2006.01)

(52) U.S. Cl. ..... 340/573.1; 340/309.16; 340/539.11; 340/539.12; 340/692; 381/23.1

(58) Field of Classification Search ..... 340/573.1, 340/539.11, 539.12, 309.16, 692; 381/23.1, 381/74; 600/300, 559; 128/903, 904
See application file for complete search history.

(56) References Cited

U.S. PATENT DOCUMENTS

| | | | | |
|---|---|---|---|---|
| 4,472,069 | A | 9/1984 | Yamamoto | |
| 4,768,022 | A | 8/1988 | Patterson | |
| 4,934,378 | A * | 6/1990 | Perry, Jr. | 600/590 |
| 5,646,912 | A * | 7/1997 | Cousin | 368/10 |
| 5,721,783 | A * | 2/1998 | Anderson | 381/328 |
| 5,731,757 | A * | 3/1998 | Layson, Jr. | 340/573.1 |
| 6,102,855 | A * | 8/2000 | Kehr et al. | 600/300 |
| 6,229,900 | B1 | 5/2001 | Leenen | |
| 6,283,915 | B1 | 9/2001 | Aceti et al. | |
| 6,398,727 | B1 | 6/2002 | Bui et al. | |
| 6,544,199 | B1 * | 4/2003 | Morris | 600/590 |
| 6,696,924 | B1 * | 2/2004 | Socinski | 340/309.4 |
| 2001/0027384 | A1 | 10/2001 | Schulze et al. | |
| 2002/0019584 | A1 | 2/2002 | Schulze et al. | |
| 2002/0169635 | A1 * | 11/2002 | Shillingburg | 705/2 |
| 2003/0002705 | A1 | 1/2003 | Boesen | |
| 2003/0112266 | A1 * | 6/2003 | Chang et al. | 345/727 |

OTHER PUBLICATIONS

Walter J. Smoski, PhD, Hearing Aids, Jun. 11, 2002, http://www.emedicine.com/ent/topic478.htm.
International Search Report dated Mar. 14, 2006.

* cited by examiner

*Primary Examiner*—Thomas Mullen
(74) *Attorney, Agent, or Firm*—Lowenstein Sandler PC

(57) ABSTRACT

Methods and apparatus for aurally presenting predefined notification messages within an auditory canal of a user are disclosed. Aural notification is provided by positioning a device at least partially within the auditory canal, processing a digitized notification signal at the device, and aurally presenting a predefined notification message from the device responsive to the processed digitized notification signal.

23 Claims, 4 Drawing Sheets

METHODS AND APPARATUS FOR AURALLY PRESENTING NOTIFICATION MESSAGE IN AN AUDITORY CANAL

FIELD OF THE INVENTION

The present invention relates to methods and apparatus for aurally presenting notification messages within an auditory canal of a user. For example, the present invention may be used to present messages reminding the user to take a prescribed medication or requesting that an Alzheimer patient "check-in" with a care provider.

BACKGROUND OF THE INVENTION

Prescription drugs are generally prescribed for ingestion according to a predefined schedule, e.g., twice a day. Many people find it difficult to follow prescription drug schedules for a variety of reasons, e.g., they are too busy, have mental deficiencies, or experience memory loss due to the drugs themselves. In addition, two or more prescription drugs having different schedules are frequently prescribed concurrently, making it even more difficult to follow the prescription drug schedules.

Devices are presently available to assist people in following their predefined prescription drug schedules. These devices include low technology devices such as pill boxes and more sophisticated electronic devices. Pill boxes typically include chambers indicating the days of the week on which a particular prescription drug ingestion dosage (e.g., a pill) contained therein is to be ingested. Electronic devices are typically programmed to provide notification based on previously entered date and time information. To assist a person (herein "user") in following a prescription drug schedule, the user must ensure that they are always in the vicinity of the device and/or regularly check the device. Frequently, the devices are misplaced or are not checked regularly, thereby obviating their usefulness. Additionally, these devices are incapable of notifying an interested party, e.g., a relative, friend, or care provider, if the prescription drug schedule is not being followed. Further, these devices do not provide for confirming and/or recording that a prescription drug is taken.

Alzheimer patients suffer from a condition that results in impaired mental functions. People inflicted with this condition are typically monitored to prevent them from injuring themselves or wandering away from home. Existing techniques for monitoring Alzheimer patients involves constant supervision or periodic personal contact with the patient, e.g., in person or via the telephone. Constant monitoring and periodic personal contacts are expensive. In addition, for a telephone contact to be effective, the patient must be within audible range of the telephone. If the patient is in a room of their home from which the telephone can not be heard or is performing an activity such as vacuuming that interferes with the patient's ability to hear the telephone ring, false alarms may occur. For example, a care provider attempting to contact an Alzheimer patient may incorrectly conclude that the patient has wandered away from home when they are simply in a room such as a basement where they are unable to hear the telephone.

Accordingly, improved methods and apparatus are needed for ensuring compliance with prescription drug schedules and monitoring Alzheimer patients that are not subject to the above limitations. The present invention addresses these needs among others.

SUMMARY OF THE INVENTION

The present invention is embodied in methods and apparatus for aurally presenting predefined notification messages within an auditory canal of a user. Aural notification is provided by positioning a device at least partially within the auditory canal, processing a digitized notification signal at the device, and aurally presenting a predefined notification message from the device responsive to the processed digitized notification signal.

BRIEF DESCRIPTION OF THE DRAWINGS

The invention is best understood from the following detailed description when read in connection with the accompanying drawings, with like elements having the same reference numerals. This emphasizes that, according to common practice, the various features of the drawings are not drawn to scale. On the contrary, the dimensions of the various features are arbitrarily expanded or reduced for clarity. Included in the drawings are the following figures.

DETAILED DESCRIPTION OF THE INVENTION

Figure 1:
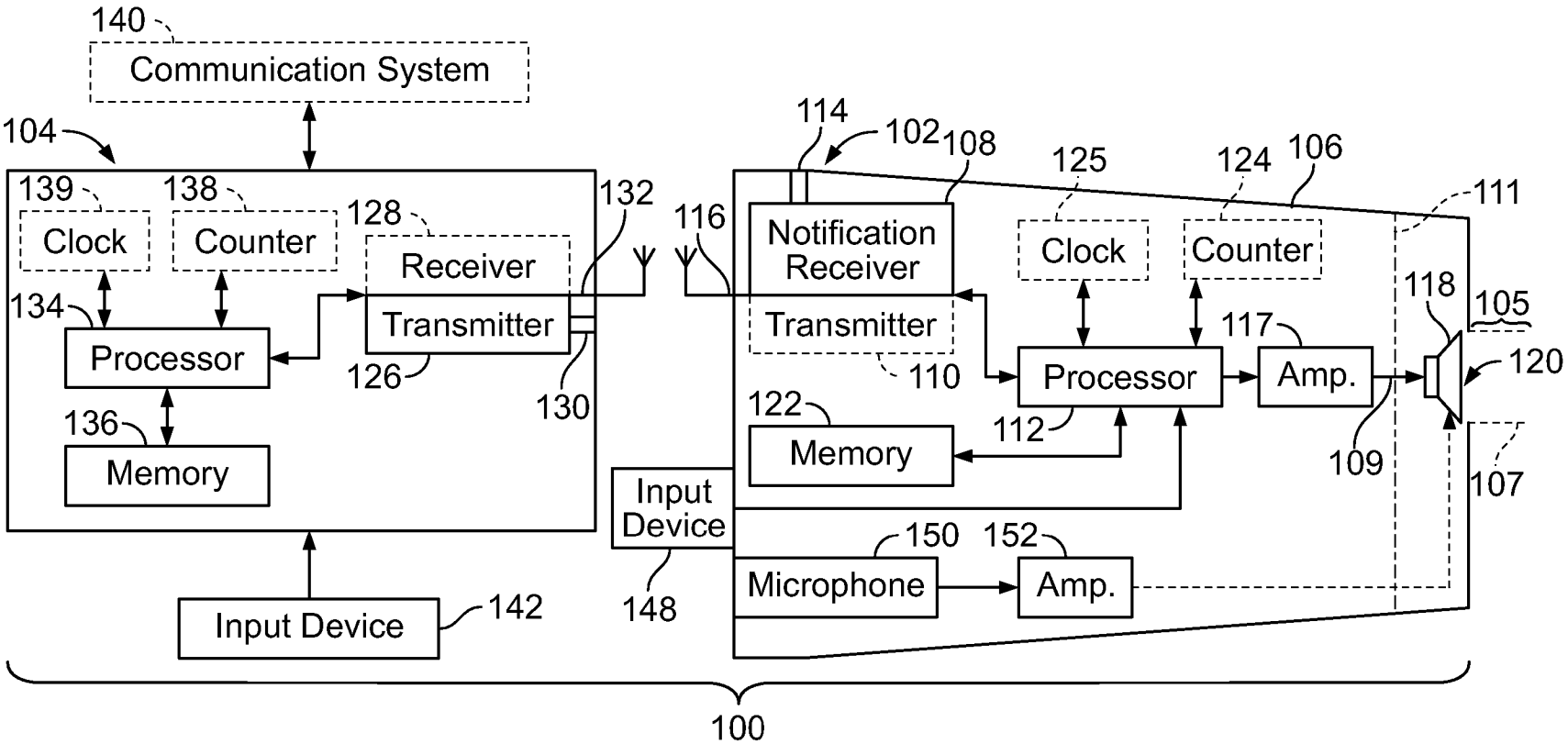
FIG. 1 is a block diagram of an exemplary notification system in accordance with the present invention.

FIG. 1 depicts an exemplary notification system 100 in accordance with the present invention. The exemplary notification system 100 includes an aural presentation device 102 and an external device 104. A description of components within the exemplary notification system 100 is first provided followed by methods for using the exemplary notification system 100.

The aural presentation device 102 is configured to aurally present a predefined notification message from within an auditory canal of a user. In addition, the aural presentation device 102 may be configured to provide hearing aid functionality.

For puwoses of illustration, and not by way of limitation, the following described embodiments of aural presentation device 102 are provided. In an exemplary embodiment, the housing 106 of the aural presentation device 102 is configured for placement entirely within, or at least partially within, the auditory canal of the user. In accordance with this exemplary embodiment, predefined notification messages are presented in the auditory canal via a speaker 118 positioned within the housing 106, e.g., through one or more openings 120 provided in the housing 106. In an alternative exemplary embodiment, the housing 106 may be configured for placement external to the auditory canal, e.g., between the auricle of the ear and the head of the user (not shown). Structurally configuring the shape of the housing 106 to be situated between the auricle of the ear and the head of the user is well understood and frequently practiced in the art of hearing aid devices. In accordance with this alternative exemplary embodiment, predefined notification messages are aurally presented into the auditory canal via an aural presentation extension 105 extending from the housing 106. The aural presentation extension 105 may be an acoustical tube 107 extending from the speaker 118 positioned at the opening 120 of the housing 106 into the auditory canal. Speaker 118 may alternatively be provided directly within the auditory canal by positioning the speaker 118 at the ear canal receiving end of the aural presentation extension 105 and extending an electrical connection 109 through the aural presentation extension 105 from the components within the housing 106 to the speaker 118. Where the housing is external to the auditory canal and the speaker is within the auditory canal, the electrical connection and the speaker may be at least partially surrounded by a semi-rigid sheath (not shown). A vertical dashed line 111 extending through the aural presentation device 102 indicates that the speaker 118 may be part of the housing 106 or separate from the housing 106. Suitable housings, acoustical tubes 107, and electrical connections 109 for use with the present invention will be understood by one of skill in the art from the description herein.

A notification system receiver 108 positioned within the housing 106 is configured to receive signals, e.g., from the external device 104. An optional transmitter 110 configured to transmit communication signals, e.g., to the external device 104, may further be positioned within the housing 106. The notification system receiver 108 and transmitter 110 may be independent or combined as a transceiver. The notification system receiver 108 may be a data interface. The notification system receiver 108 and/or the transmitter 110 may communicate via a wired communication port 114 or a wireless connection, e.g., using an infra red (IR) LED or a radio frequency (RF) connection through an antenna 116.

A processor 112 is coupled to the notification system receiver 108 and the transmitter 110 (if present). In addition, the processor 112 is coupled to the speaker 118 (e.g., via an amplifier 117), a memory 122, an optional counter 124, and an optional clock 125. The processor 112 is configured to receive data via the notification system receiver 108, transmit data via the transmitter 110 (if present), store and retrieve data from the memory 122, and interact with the counter 124 and/or clock 125 (if present). In addition, the processor 112 is configured to process data from the notification system receiver 108, the memory 122, the counter 124, and/or the clock 125 and is further configured to drive the speaker 118 (e.g., via the amplifier 117) to aurally present predefined notification messages based on the processed data. The processor 112 may further be configured to convert compressed audio signals into signals suitable for aural presentation. The audio signals may be compressed to reduce transmission bandwidth and/or to maximize use of the memory 122. An input device 148 such as a button may further be coupled to the processor 112 and positioned on the housing 106 to receive feedback from a user. A suitable processor for use with the present invention will be understood by one of skill in the art.

The aural presentation device 102 may optionally include components to provide hearing aid functionality. In the illustrated aural presentation device 102, a microphone 150 converts sound signals into electrical signals, an amplifier 152 increases the amplitude of the electrical signals, and the speaker 118 changes the amplified electrical signal back into sound energy that is directed into the auditory canal of the user. The speaker 118 (commonly referred to as the receiver in a hearing aid) may be the same speaker used for notification purposes or may be a separate speaker. Suitable microphones, amplifiers, and speakers/hearing aid receivers will be understood by one of skill in the art.

The external device 104 includes a transmitter 126 configured for transmitting signals to the notification system receiver 108 of the aural presentation device 102. The external device 104 may further include an optional receiver 128 configured for receiving signals from the transmitter 110 of the aural presentation device 102. The transmitter 126 and the receiver 128 may be independent or combined as a transceiver. The transmitter 126 and/or the receiver 128 may communicate via a wired communication port 130 or a wireless connection, e.g., through an antenna 132. The transmitter 130 may be a data interface.

Signals transmitted between the external device 104 and the aural presentation device 102 may include data identifying the source and/or desired destination of the transmitted signals. This enables the use of one or more external devices (represented by external device 104) with one or more aural presentation devices (represented by aural presentation device 102) in the same vicinity. For example, a single external device may be used with a single aural presentation device, a single external device may be used with a plurality of aural presentation devices, a plurality of external devices may be used with a single aural presentation device, and a plurality of external devices may be used with a plurality of aural presentation devices.

In an exemplary system, a string of data may be included with each transmission from a first external device to a first aural presentation device that identifies both the first external device and the first aural presentation device. When the message is received at the first aural presentation device, the first aural presentation device checks the string of data and processes the transmission if the string of data indicates that the first aural presentation device is the intended recipient. Likewise, an acknowledgement from the first aural presentation device to the first external device may include a similar string of data. When the acknowledgment is received at the first external device, the first external device checks the string of data and processes the transmission if the string of data indicates that the first external device is the intended recipient of the acknowledgment.

The external device 104 is configured to receive data via one or more input devices (represented by input device 142). One or more of the input devices may be incorporated into the external device 104. The input devices may include a button, switch, keyboard, touch pad, touch screen, mouse, microphone, or essentially any device capable of generating a signal conveying information. The input device 142 may be used to enter notification schedules and to receive feedback from a user with the aural presentation device positioned within their auditory canal. The external device 104 may optionally be configured to receive and/or transmit communication signals via a communication system 140, such as a telephone system or the Internet. The communication system 140 enables an interested party, e.g., a relative, friend, or care provider, to instigate predefined notification messages, enter notification schedules and/or receive feedback from the notification system 100. For example, an interested party could contact the external device 104 via the communication system 140 using a cell phone, personal digital assistant (PDA), or essentially any communication device and remotely cause a message to be aurally presented, e.g., by entering a number corresponding to a particular predefined notification message. Additionally, the communication system may receive audio and/or text notification messages. In embodiments where text notification messages are received, the external device 104 may include a text to speech converter (not shown) to convert the text message to an aural notification message.

A processor 134 within the external device 104 is coupled to the transmitter 126 and to the receiver 128 (if present).

The processor 134 is further coupled to a memory 136, the input device 142, an optional counter 138, an optional clock 139, and the communication system 140 (if present). The processor 134 is configured to transmit data via the transmitter 126, receive data via the receiver 128 (if present), receive data via the input device 142, store and retrieve data from the memory 136, and interact with the counter 138 and/or clock 139 (if present). The transmitted and received data may include the data described above for identifying particular external devices and aural presentation devices. In addition, the processor 134 is configured to process data from the communication system 140 (if present), input device 142, memory 136, and counter 138 and/or clock 139 (if present), and is further configured to transmit data responsive to the processed data via the transmitter 126. A suitable processor for use with the present invention will be understood by one of skill in the art.

Figure 2:
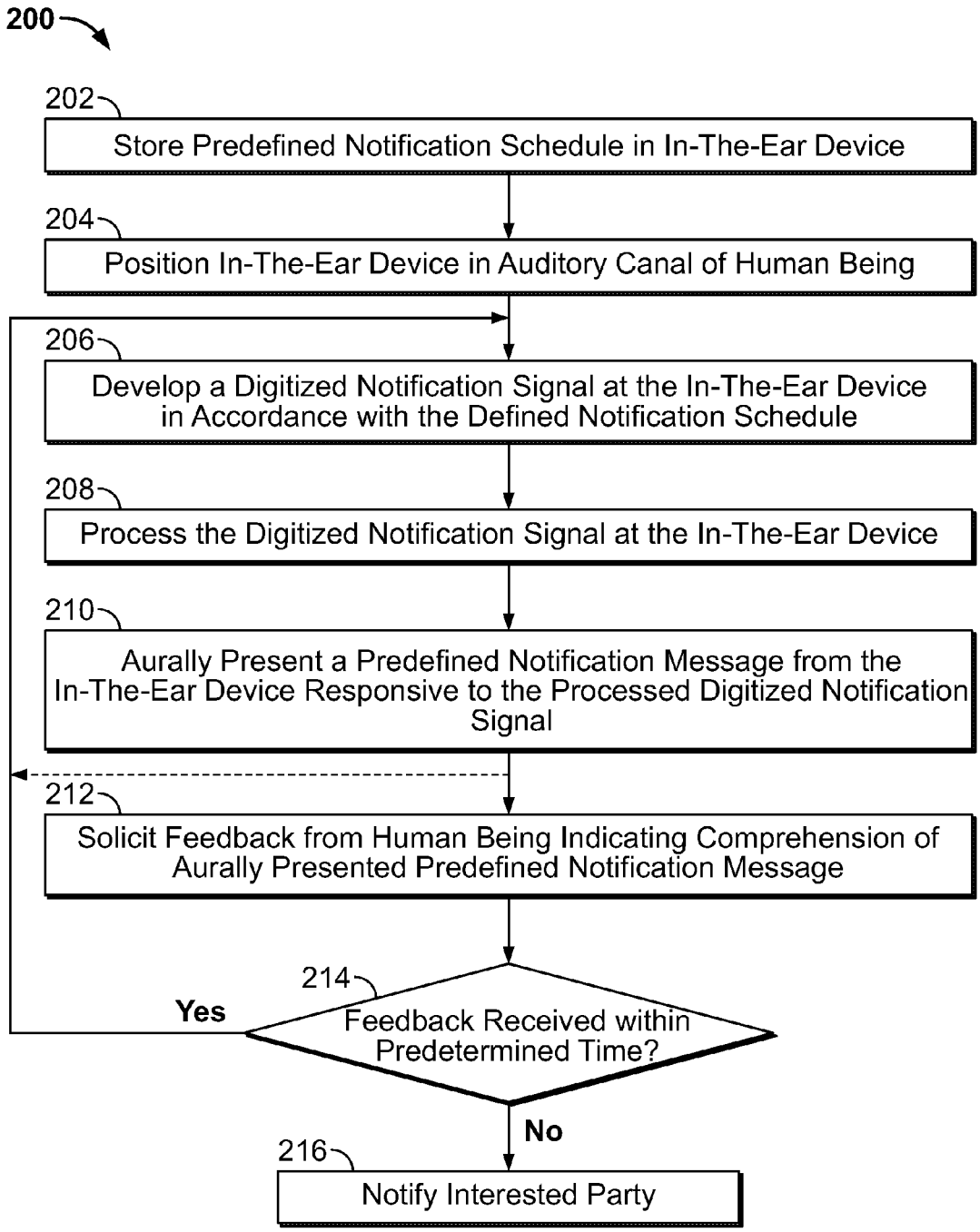
FIG. 2 is a flow chart of an exemplary notification method in accordance with the present invention.

FIG. 2 depicts a flow chart 200 of exemplary steps for aurally presenting a predefined notification message to a user. The steps of flow chart 200 are described with reference to the exemplary notification system 100 of FIG. 1 in which the aural presentation device 102 is positioned at least partially within the auditory canal of a user.

At block 202, the aural presentation device 102 stores a predefined notification schedule and one or more predefined notification messages. In an exemplary embodiment, the external device 104 receives the predefined notification schedule and messages from an external source (e.g., via the communication system 140 of the input device 142) or generates the predefined notification schedule and messages based on data received from the external source. The external device 104 then passes the predefined notification schedule and messages to the aural presentation device 102 for storage via a wired or wireless connection. In an alternative exemplary embodiment, the aural presentation device 102 generates the predefined notification signals and/or messages based on data received from the external device 104. The predefined notification messages may be received from the external device 104 as "streaming audio" for storage in the aural presentation device 102.

The predefined notification schedule is a schedule for aurally presenting predefined notification messages. The predefined notification schedule may be a schedule including entries dictating a particular time and/or frequency for ingesting one or more prescription drug dosages (e.g., pills). For example, the notification schedule may include entries to take a particular pill at 8:00 a.m. every day or to take a particular pill at eight hour intervals. In addition, the predefined notification schedule may dictate when an Alzheimer patient should check-in with an interested party, e.g., every half hour.

The predefined notification messages are messages for aural presentation corresponding to entries in the predefined notification schedule. For example, the predefined notification schedule may contain an entry dictating that an aspirin should be ingested at 4 p.m. and a corresponding predefined notification message may be "It is now time to take an aspirin" to be aurally presented at 4 p.m. in accordance with the notification schedule. In another example, the predefined notification schedule may contain an entry indication that the user should check-in with an interested party, e.g., via an input device 142, every half-hour and a corresponding predefined notification message may be "Please check-in with your care provider by pressing the red button on the notification system" to be aurally presented every half hour.

The predefined notification schedules and/or messages may be provided via the communication system 140 by a physician's office that prescribed a prescription drug, by a care provider for the user, and/or by the user. In addition, the predefined notification schedule and/or message may be provided via the input device 142 by a care provider and/or the user. Various alternative methods for providing notification schedules and/or messages to the notification system 100 will be understood by those of skill in the art from the description herein.

At block 204, the aural presentation device 102 is positioned at least partially within the auditory canal of the user. In an exemplary embodiment, the aural presentation device 102 is designed to be positioned entirely within the auditory canal of the user. In an alternative exemplary embodiment, the aural presentation device is designed to be positioned partially within the auditory canal. In accordance with this embodiment, the housing of the aural presentation device 102 may be positioned external to the auditory canal, e.g., between the auricle of the ear and the head of the user, and another portion of the aural presentation device 102 may be positioned within the ear. The portion of the aural presentation device 102 positioned within the auditory canal may be an acoustical tube 107 extending from the housing into the auditory canal to transfer acoustic signals from the speaker 118 in the housing to the auditory canal. Alternatively, the portion of the aural presentation device 102 positioned within the auditory canal may be the speaker 118, which is coupled to the components of aural presentation device within the housing 106 via an electrical connection 109.

In an exemplary embodiment, the aural presentation device 102 is positioned at least partially within the auditory canal after the predefined notification schedule is stored in the aural presentation device 102. In an alternative exemplary embodiment, the predefined notification schedule may be stored in the aural presentation device 102 after the device 102 is positioned at least partially within the auditory canal in addition to, or instead of, before the aural presentation device 102 is positioned at least partially within the auditory canal. In this alternative exemplary embodiment, the step of block 204 is performed before the step of block 202.

At block 206, the aural presentation device 102 develops a digitized notification signal in accordance with the predefined notification schedule. In an exemplary embodiment, the processor 112 develops the digitized notification signal based on the predefined notification schedule stored in the memory 122 and the counter 124 and/or clock 125, which in conjunction with the processor 112 tracks relative and/or current time. Where relative time is tracked, the notification schedule may include entries to take a particular pill at a particular interval, e.g., every 4 hours. The processor 112 may then set a flag to develop an appropriate digitized notification signal at the appropriate interval, e.g., after a number of counter pulses corresponding to 4 hours. Where current time is tracked, the notification schedule may include entries to take a particular pill at a particular time, e.g., 8:00 a.m. The processor 112 may then set a flag to develop an appropriate digitized notification signal at the appropriate time, e.g., 8:00 a.m. The digitized notification signal may be, for example, a numerical representation corresponding to a predefined notification message for aural presentation to the user.

At block 208, the aural presentation device 102 processes the digitized notification signal. In an exemplary embodiment, the processor 112 of the aural presentation device 102 processes the digitized notification signal to select and process a corresponding predefined notification message. If the digitized notification signal corresponds to a first predefined notification message, the first predefined notification message is selected and processed for aural presentation. Likewise, if the digitized notification signal corresponds to a second predefined notification message, the second predefined notification message is selected and processed for aural presentation.

At block 210, the aural presentation device 102 aurally presents a predefined notification message responsive to the processed digitized notification signal. In an exemplary embodiment, the processor 112 presents the predefined notification message selected at block 208 via the speaker 118 once processing of the digitized notification signal is complete.

In an exemplary embodiment, at block 212, the notification system 100 optionally solicits feedback from the user indicating that the user comprehended the aurally presented predefined notification message. Feedback may be solicited as part of the predefined notification message. For example, the predefined notification message may state "please take one pill at 8:00 a.m. and depress the red button on the notification system after taking the pill," or "please take your pill and depress the button on the device in your ear." In addition, in the case of an Alzheimer patient, the predefined notification message may simply be a message soliciting a response from the Alzheimer patient, e.g., "Please depress the red button on the notification system," or "please depress the button on the device in your ear."

At block 214, a decision is made, e.g., by the processor 130 of the external device 104, regarding whether feedback was received within a predefined time period, e.g., based on data provided by the counter 124. For example, after the predefined notification message is aurally presented, the user may have ten minutes to provide feedback, e.g., via the input device 134 of the external device 104 or the input device 148 of the aural presentation device 102. Feedback may be provided by an acknowledgement signal generated by the external device 104 in response to an input received via the input device 134 or an input received via the input device 148 and communicated to the external device 104. If feedback is received within the predefined time period, processing resumes at block 206 with the steps of blocks 206 through 214 repeated. Alternatively, if feedback is not received within the predefined time period, an interested party is notified, e.g., via the communication system 140, at block 216. In an exemplary embodiment, the predefined notification message soliciting feedback (see blocks 210 and 212) is repeated one or more times before notifying the interested party.

In an alternative exemplary embodiment, feedback is not solicited. In accordance with this embodiment, the steps of blocks 212 through 216 are omitted and processing resumes at block 206 after block 210.

Figure 3:
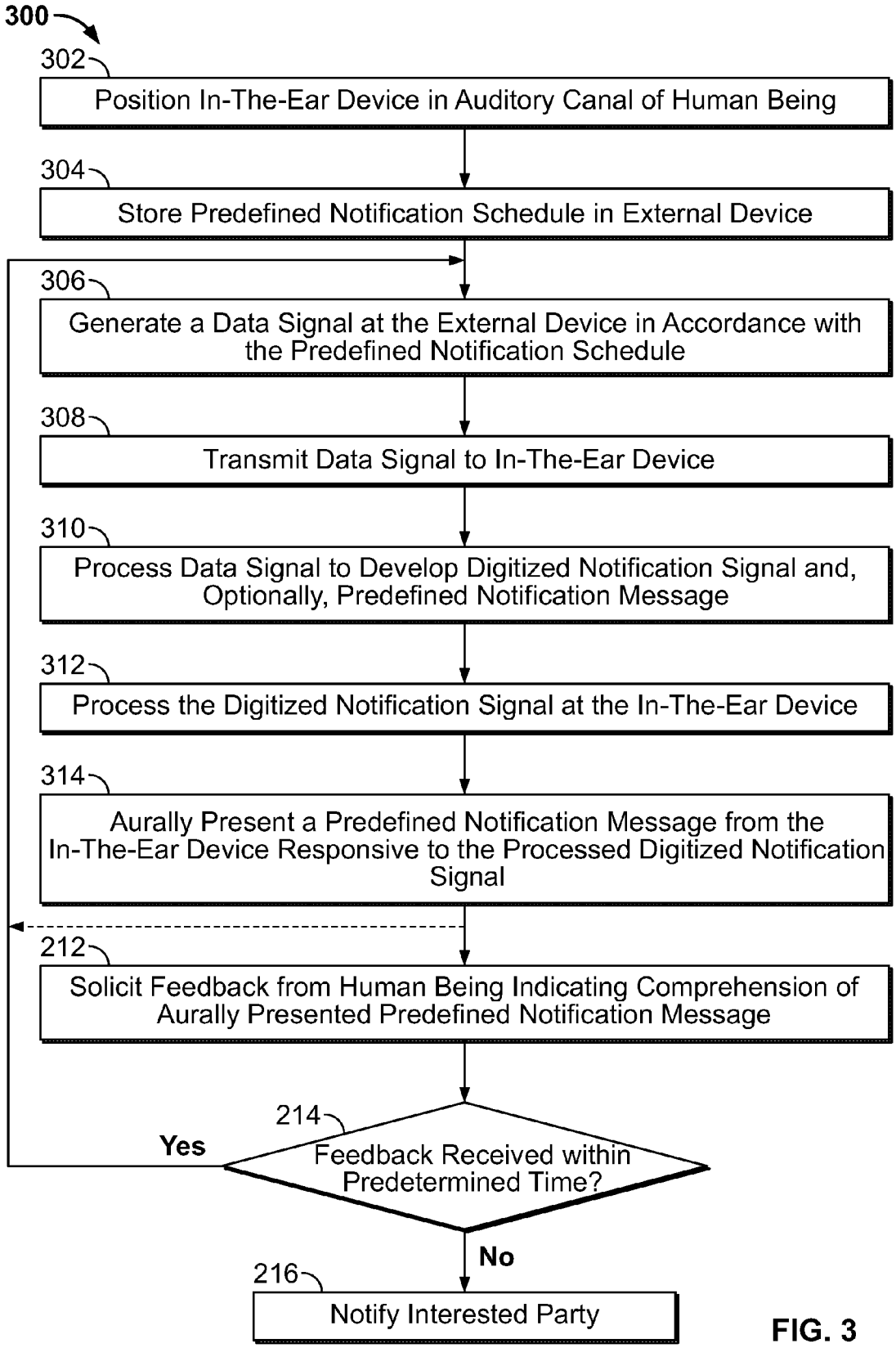
FIG. 3 is a flow chart of an alternative exemplary notification method in accordance with the present invention.

FIG. 3 depicts a flow chart 300 of alternative exemplary steps for aurally presenting a predefined notification message to the user. The steps of flow chart 300 are described with reference to the exemplary notification system 100 of FIG. 1.

At block 302, the aural presentation device 102 is positioned at least partially within the auditory canal of the user as described above with reference to the step of block 204.

At block 304, a predefined notification schedule and optionally one or more corresponding messages are stored in the external device 104. In an exemplary embodiment, the external device 104 receives the predefined notification schedule and messages from an external source or generates the predefined notification schedule and messages based on data received via the communication system 140 or the input device 142.

At block 306, the external device 104 generates a data signal in accordance with the predefined notification schedule. In an exemplary embodiment, the processor 134 within the external device 104 generates the data signal based on the predefined notification schedule stored in the memory 136 and the counter 138 and/or clock 139. The data signal may be, for example, a numerical representation corresponding to a predefined notification message that is stored in the aural presentation device 102 for aural presentation to the user. Alternatively, the data signal may include the predefined notification message.

At block 308, the external device 104 transmits the data signal to the aural presentation device 102, e.g., from the transmitter 126 to the receiver 108 via a wired or wireless connection. The data signal may include a data string identifying the external device 104 and/or the aural presentation device 102.

At block 310, the aural presentation device 102 processes the data signal received from the external device 104 to develop a digitized notification signal and optionally the corresponding predefined notification message if included therein. In an exemplary embodiment, where the data signal from the external device 104 includes the predefined corresponding predefined notification message, the processor 112 processes the data signal to develop a digitized notification signal including the corresponding predefined notification message. In an alternative exemplary embodiment, where the predefined notification message is stored in the memory 120, e.g., prior to inserting the aural presentation device 102 into the auditory canal, the processor 134 processes the data signal received from the external device 104 to develop the digitized notification signal only.

At block 312, the aural presentation device 102 processes the digitized notification signal. In an exemplary embodiment, where the digitized notification signal includes the corresponding predefined notification message, the processor 112 processes the digitized notification signal for presentation. In an alternative exemplary embodiment, where the predefined notification message is previously stored in the memory 122 of the aural presentation device 102, the processor 112 processes the digitized notification signal to select and process a corresponding predefined notification message from the memory 122 for presentation.

At block 314, the aural presentation device 102 aurally presents the predefined notification message responsive to the processed digitized notification signal. In an exemplary embodiment, the processor 112 presents the predefined notification message via the speaker 118 once processing of the digitized notification signal is complete.

At blocks 212 through 216, the notification system 100 optionally solicits feedback as described above. In an alternative exemplary embodiment, feedback is not solicited. In accordance with this embodiment, the steps of blocks 212 through 216 are omitted and processing resumes at block 306 after block 314.

Figure 4:
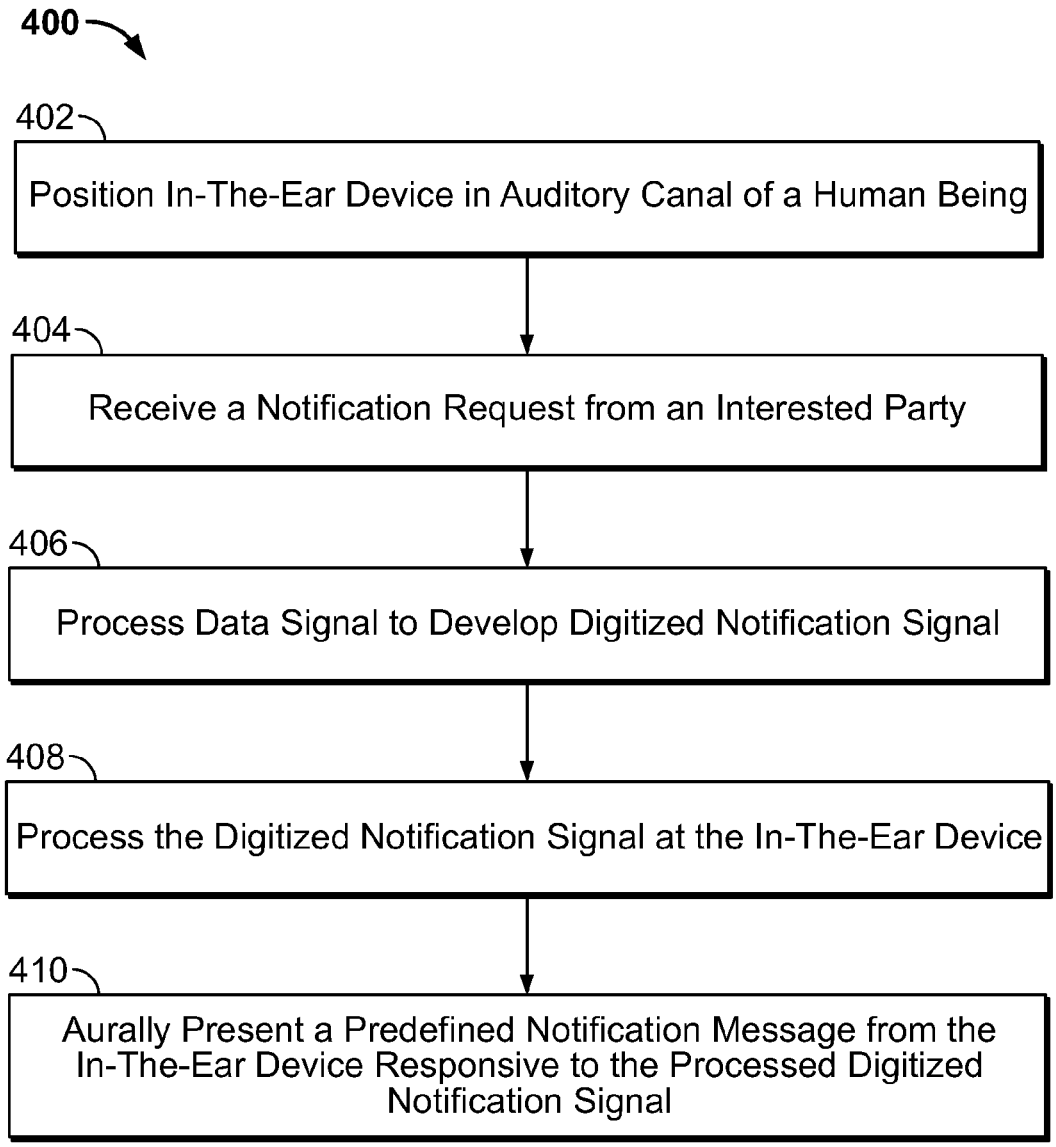
FIG. 4 is a flow chart of an alternative exemplary notification method in accordance with the present invention.

FIG. 4 depicts a flow chart 400 of alternative exemplary steps for aurally presenting a predefined notification message to the user. The steps of flow chart 400 are described with reference to the exemplary notification system 100 of FIG. 1.

At block 402, the aural presentation device 102 is positioned at least partially within the auditory canal of the user as described above with reference to the steps of blocks 204 and 302.

At block 404, a notification request is received from an interested party. In an exemplary embodiment, the notification request is received via the communication system 140 at the external device 104. The processor 134 within the external device 104 processes the notification request to generate a data signal and passes the data signal to the aural presentation device 102 via a wired or wireless connection. The processor 134 may insert a predefined notification message within the data signal.

At block 406, the aural presentation device 102 processes the data signal to develop a digitized notification signal. In an exemplary embodiment, the processor 112 within the aural presentation device receives and processes the data signal to obtain the digitized notification signal, which may include a corresponding predefined notification message if present within the data signal.

At block 408, the aural presentation device 102 processes the digitized notification signal. In an exemplary embodiment, where the digitized notification signal includes the corresponding predefined notification message, the processor 112 processes the digitized notification signal for presentation. In an alternative exemplary embodiment, the corresponding predefined notification message is stored in the memory 122 and the processor 112 processes the digitized notification signal to select and process the corresponding predefined notification message for presentation.

At block 410, the aural presentation device 102 aurally presents the predefined notification message responsive to the processed digitized notification signal. The predefined notification message may include a statement asking the user to contact the interested party, e.g., through the communication system 140 via the input device 142 connected to the external device 104 or directly using a conventional communication system such as the telephone.

The methods of the present invention can be used by way of non-limiting examples to request that a user with Alzheimer's check-in with an interested party either at programmed intervals or at the request of the interested party, remind a user to take a prescription drug at a particular time or at a particular interval, and remind a user of an appointment with a care provider. In addition, the present invention may be used to acknowledge receipt of a request for assistance from a hospital patient, notify a hospital patient to proceed to another area (e.g., go to x-ray), and notify a user to go to the doctor. Further, the present invention may be used in the entertainment, financial, and advertisement fields. Entertainment venues such as theme parks can use the present invention to inform attendees of which restaurants are open and which rides have the shortest lines. Financial institutions such as stock and commodities exchanges can use the present invention to notify a "trader" to sell or buy stock. The present invention can also be used in advertising to inform the users of specific products. Various other uses for the present invention will be understood by those of skill in the art from the description herein.

Because the aural presentation device is at least partially positioned within the auditory canal of the user, the aural presentation device remains with the user at all times, is unlikely to be misplaced, and does not interfere with physical activity. In addition, since the aural presentation device is positioned to aurally present predefined notification messages from within the auditory canal, the user is able to hear the predefined notification messages regardless of their location or the activities they are performing. Also, the use of predefined notification messages is especially advantageous for users with limited mental capabilities, which may find the predefined notification messages less confusing. Further, the aural presentation device is comfortable to wear and permits normal hearing, either via channels (not shown) extending through and/or on the surface of the housing 106 or via hearing aid components such as the microphone 150, amplifier 152, and speaker 118 (see FIG. 1).

It is contemplated that one or more method steps in accordance with the invention may be implemented in software. The software may be embodied in a computer readable carrier, for example, a magnetic or optical disk, a memory-card or an audio frequency, radio-frequency, or optical carrier wave.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. An apparatus for aurally presenting predefined notification messages within an auditory canal of a user, the apparatus comprising:

a housing;

a speaker coupled to the housing for aurally presenting a predefined notification message, wherein the speaker is configured to be situated within the auditory canal; and a processor provided within the housing configured to generate a digitized notification signal in accordance with a predefined notification schedule, wherein the predefined notification message is presented in response to the digitized notification signal.

2. The apparatus of claim 1, wherein the housing is configured for placement at least partially within the auditory canal.

3. The apparatus of claim 2, wherein the speaker is fixed at least partially within the housing configured for placement at least partially within the auditory canal.

4. The apparatus of claim 1, wherein the housing is configured for placement between an auricle and a head of the user.

5. The apparatus of claim 4, wherein the speaker is external to the housing and coupled to the housing through an aural presentation extension, and wherein an electrical connection is provided through at least a portion of the aural presentation extension to connect the speaker to the processor.

6. The apparatus of claim 5, wherein the aural presentation extension is configured to receive the speaker such that the speaker is within the auditory canal when the aural presentation extension is inserted into the ear.

7. The apparatus of claim 1, further comprising:

a memory component for storing predefined notification messages; and a notification receiver for receiving a data signal from an external device provided at a location remote from the auditory canal.

8. The apparatus of claim 7, wherein the notification receiver is coupled to the processor, and wherein the processor is further configured to process the data signal to generate the digitized notification signal.

9. The apparatus of claim 8, wherein the predefined notification message corresponding to the digitized notification signal is selected from the memory component.

10. The apparatus of claim 7, wherein the external device further comprises an input device for receiving an acknowledgement signal from the user indicating comprehension of the aurally presented predefined notification message.

11. The apparatus of claim 10, wherein the external device further comprises a communication system interface for notifying an interested party if the signal from the user indicating comprehension is not received within a predefined period of time from aural presentation of the predefined notification message.

12. The apparatus of claim 7, wherein the external device further comprises a communication system interface for receiving a notification request, and wherein the external device is further configured to generate the data signal in response to the notification request.

13. The apparatus of claim 1, further comprising:

an input device coupled to the housing for receiving an acknowledgement signal from the user indicating comprehension of the aurally presented predefined notification message;

a transmitter coupled to the input device for transmitting the acknowledgement signal received at the input device; and an external device provided at a location remote from the auditory canal, wherein the external device is configured to receive the acknowledgement signal transmitted by the transmitter.

14. The apparatus of claim 13, wherein the external device further comprises a communication system interface for notifying an interested party if the signal from the user indicating comprehension is not received within a predefined period of time from aural presentation of the predefined notification message.

15. The apparatus of claim 1, further comprising a microphone coupled to the speaker, wherein the microphone is configured to receive acoustic signals exterior to the auditory canal for aural presentation by the speaker within the auditory canal.

16. The apparatus of claim 1, further comprising a clock coupled to the processor, wherein the processor is further configured to generate the digitized notification signal in accordance with the predefined notification schedule and the clock.

17. A method for aurally presenting predefined notification messages within an auditory canal of a user, the method comprising the steps of:

attaching a device to the user, wherein the device houses a processor coupled with a speaker;

generating a digitized notification signal in accordance with a predefined notification schedule;

processing the digitized notification signal; and aurally presenting within the auditory canal a predefined notification message in response to the digitized notification signal.

18. The method of claim 17, further comprising the steps of:

receiving a notification request at an external device provided at a location remote from the auditory canal;

generating a data signal at the external device in response to the notification request;

transmitting the data signal to the device attached to the user; and processing the data signal to generate the digitized notification signal.

19. The method of claim 18, further comprising the step of selecting the predefined notification message corresponding to the generated digitized notification signal for aural presentation within the auditory canal.

20. The method of claim 17, further comprising the step of:

soliciting feedback from the user indicating comprehension of the predefined notification message; and notifying an interested party if the solicited feedback is not received within a predefined time from the aural presentation of the predefined notification message.

21. The method of claim 17, further comprising the step of:

soliciting feedback from the user indicating compliance with the predefined notification message; and reminding the user if the solicited feedback is not received within a predefined time from the aural presentation of the predefined notification message.

22. The method of claim 17, wherein a device is attached to the user by positioning the device at least partially within the auditory canal of the user.

23. The method of claim 17, wherein a device is attached to the user by positioning the device between an auricle and a head of the user.

* * * * *